US009478383B2

(12) United States Patent
Lee et al.

(10) Patent No.: US 9,478,383 B2
(45) Date of Patent: Oct. 25, 2016

(54) FAST SWITCH

(71) Applicant: LSIS CO., LTD., Anyang-si, Gyeonggi-do (KR)

(72) Inventors: Gyeong Ho Lee, Cheongju-si (KR); Jung Wook Sim, Cheongju-si (KR); Hae Yong Park, Changwon-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/666,021

(22) Filed: Mar. 23, 2015

(65) Prior Publication Data

US 2015/0332884 A1 Nov. 19, 2015

(30) Foreign Application Priority Data

May 13, 2014 (KR) ..... 10-2014-0057435

(51) Int. Cl.

| | |
|---|---|
| ***H01H 33/00*** | (2006.01) |
| ***H01H 83/02*** | (2006.01) |
| ***H01H 33/16*** | (2006.01) |
| ***H01H 33/66*** | (2006.01) |
| ***H01H 71/24*** | (2006.01) |

(52) U.S. Cl.

CPC ..... *H01H 83/02* (2013.01); *H01H 33/167* (2013.01); *H01H 33/66* (2013.01); *H01H 71/2409* (2013.01)

(58) Field of Classification Search

USPC ..... 361/115

See application file for complete search history.

(56) References Cited

U.S. PATENT DOCUMENTS

| | | | | |
|---|---|---|---|---|
| 3,319,121 | A * | 5/1967 | Lee | H02H 3/20 218/140 |
| 3,411,038 | A * | 11/1968 | Lee | H01H 33/66 218/140 |
| 2010/0165533 | A1 | 7/2010 | Lee et al. | |
| 2013/0194703 | A1 | 8/2013 | Husband et al. | |
| 2015/0108090 | A1 * | 4/2015 | Oates | H01H 33/596 218/10 |

(Continued)

FOREIGN PATENT DOCUMENTS

| | | |
|---|---|---|
| CN | 203573898 | 4/2014 |
| JP | 2000-299041 | 10/2000 |
| JP | 2004-103318 | 4/2004 |

(Continued)

OTHER PUBLICATIONS

European Patent Office Application Serial No. 1561378.3, Search Report dated Oct. 22, 2015, 8 pages.

(Continued)

*Primary Examiner* — Ronald W Leja

(74) *Attorney, Agent, or Firm* — Lee, Hong, Degerman, Kang & Waimey PC; Jonathan Kang; Justin Lee

(57) ABSTRACT

The fast switch includes: a housing; a vacuum interrupter installed in the housing, connected to a main circuit, and configured to open and close the main circuit; a contact spring coupled to a mover of the vacuum interrupter, and configured to provide a contact force; an insulating rod connected to the contact spring; a permanent magnet actuator connected to a lower end of the insulating rod, and configured to provide a switching driving force; a first capacitor configured to provide a discharge current to a coil of the permanent magnet actuator; a driving coil connected to a lower end of the permanent magnet actuator; and a second capacitor configured to provide a discharge current to the driving coil.

8 Claims, 5 Drawing Sheets

(56) References Cited

U.S. PATENT DOCUMENTS

| | | | | |
|---|---|---|---|---|
| 2015/0206676 | A1* | 7/2015 | Sato | H01H 33/666 335/136 |
| 2015/0332884 | A1* | 11/2015 | Lee | H01H 83/02 361/42 |

FOREIGN PATENT DOCUMENTS

| | | |
|---|---|---|
| JP | 2005-38630 | 2/2005 |
| JP | 2006-236773 | 9/2006 |
| JP | 2009-212024 | 9/2009 |
| JP | 2010-272296 | 12/2010 |
| JP | 2012-129143 | 7/2012 |
| KR | 10-2009-0071094 | 7/2009 |
| KR | 10-0928937 | 11/2009 |
| KR | 10-0955373 | 4/2010 |
| KR | 10-1280288 | 7/2013 |
| KR | 10-1315967 | 10/2013 |

OTHER PUBLICATIONS

Korean Intellectual Property Office Application Serial No. 10-2014-0057435, Office Action dated Nov. 18, 2015, 5 pages.

Japan Patent Office Application Serial No. 2015-089380, Office Action dated Feb. 16, 2016, 4 pages.

* cited by examiner

FAST SWITCH

CROSS-REFERENCE TO RELATED APPLICATION

Pursuant to 35 U.S.C. §119(a), this application claims the benefit of earlier filing date and right of priority to Korean Application No. 10-2014-0057435, filed on May 13, 2014, the contents of which is incorporated by reference herein in its entirety.

BACKGROUND OF THE INVENTION

1. Field of the Invention

This specification relates to a fast switch, a component of a fault current limiter, and more particularly, a fast switch capable of constantly performing a main circuit interrupting operation, regardless of a size of a fault current, by interrupting a main circuit using a discharge current of an external capacitor.

2. Background of the Invention

Generally, a fault current limiter is a power device for protecting a power system by rapidly reducing a fault current when the large fault current occurs on the power system. That is, when a large fault current occurs on a power system, the fault current limiter reduces the fault current to a proper value or less than within a short time, thereby reducing a mechanical and thermal stress of the power device and enhancing reliability of the power system.

Such a fault current limiter may be compared with a general circuit breaker as follows. When a fault current occurs, the fault current limiter detects a breakdown rapidly and introduces a resistance (impedance). On the other hand, when a fault current occurs, the general circuit breaker separates or excludes a breakdown-occurred line from a power system by an interrupting operation. Further, it takes about 16 ms for the fault current limiter to operate after the fault current has occurred. On the other hand, it takes about 85 ms~120 ms for the general circuit breaker to operate after the fault current has occurred. Further, the fault current limiter is provided with a circuit for reducing a mechanical and thermal stress generated due to a breakdown, and for compensating for a low voltage. On the other hand, the general circuit breaker is not provided with such functions.

In a power system, when power of high quality is required and power has a large capacity, the fault current limiter is preferred owing to such advantages.

Main components of the fault current limiter include a fast fault detector (FFD), a fast switch (FS), and a current limiting resistor (CLR).

The fast fault detector (FFD) serves to rapidly-detect a breakdown occurring on a power system. When current exceeding a preset value is introduced, the FFD detects the current and thus transmits a signal to a fast switch controller.

The fast switch (FS) is composed of a main circuit contact for applying current and detouring a fault current, and a driving unit. And the fast switch (FS) serves to convert a fault current to a circuit of a current limiting resistor connected thereto in parallel.

The current limiting resistor (CLR) is not provided with current at a normal state, but is provided with a fault current when opening the fast switch (FS) by sensing a breakdown. The current limiting resistor (CLR) is a device for restricting a size of a fault current by its resistance.

FIGS. 1A and 1B illustrates a principle of a fault current limiter. FIG. 1A illustrates a circuit before a fault current limiter is installed, i.e., a circuit where only a circuit breaker is installed. FIG. 1B illustrates a circuit where a fault current limiter and a circuit breaker are installed. When a fault current limiter is installed, a normal current (①) flows to a load device 102 via a circuit breaker 101 in a normal state. However, when a breakdown occurs, a fault current (②) flows to the load device 102 by making a detour to a current limiting resistor 105 as a fast switch 104 is open by a fault current limiter 103.

In summary, a fast switch, a component of a fault current limiter, is connected to a current limiting resistor in parallel, so as to effectively control a fault current generated from a power system. The fast switch is a switching device for protecting the power system by rapidly detouring an occurred fault current to the current limiting resistor.

FIG. 2 illustrates a configuration of a fault current limiter in accordance with the conventional art. FIG. 2 illustrates a technique disclosed in Korean Registration Patent No. 10-0955373 ("Hybrid fault current limiter using superconducting device"). The conventional fault current limiter includes a superconducting device 1; a vacuum interrupter 2 connected to a rear end of the superconducting device 1 in series; a rear-end circuit breaker 8 connected to a rear end of the vacuum interrupter 2 in series, and capable of switching a circuit of the power system toward a load side; a permanent magnet actuator 3 for providing a contact force to a movable contactor 2*b* of the vacuum interrupter 2 when a normal current flows to a power supply line of the power system; a fast switch 5 having a movable contact 5*b* connected to a mover 3*a* of the permanent magnet actuator 3 so as to be moveable in a synchronized manner; and a driving coil 4 driven to a closing position for conducting the fast switch 5 by being magnetized by a fault current when the superconducting device 1 is quenched, and driven to an opening position for interrupting the vacuum interrupter 2 by the permanent magnet actuator 3.

An operation of the fault current limiter in accordance with the conventional art will be explained as follows.

In a normal state, current on a circuit flows along a conducting path (A). That is, the current is introduced along a power side line, and passes through the vacuum interrupter 2 via the superconducting device 1 of a non-resistance state, thereby being discharged to a load side through a rear-end circuit breaker 8.

When a short-circuit current occurs on the circuit, resistance of the superconducting device 1 is drastically increased. Thus, the current is smaller than the resistance of the quenched superconducting device 1, and flows along a conducting path (B). That is, the current passes through a current limiting resistor 7 and the rear-end circuit breaker 8, via the driving coil 4 connected to the superconducting device 1 in parallel, thereby flowing to the load side. In this instance, since a repulsive plate 4*a* is vertically moved by a magnetic force generated at the driving coil 4, the movable contactor 2*b* and a fixed contactor 2*a* of the vacuum interrupter 2 are separated from each other. Then, the movable contact 5*b* and a fixed contact 5*a* of the fast switch 5 come in contact with each other. Thus, the short-circuit current flowing along the conducting path (B) flows along a conducting path (C) connected to the load side via the closed fast switch, the current limiting resistor 7 and the rear-end circuit breaker 8.

However, in the conventional art, a fault current (short-circuit current) is used when an opening operation is performed. This may cause an operation speed to be variable according to a size of the fault current. And, there may exist a proper fault current section for completion of the opening operation. That is, when a fault current is small, an electronic repulsive force is small. This may cause the fault current limiter not to operate. On the other hand, when a fault current is too large, the circuit is immediately re-closed by a mechanical repulsive force.

SUMMARY OF THE INVENTION

Therefore, an aspect of the detailed description is to provide a fast switch capable of constantly performing a main circuit interrupting operation, regardless of a size of a fault current, by interrupting a main circuit using a discharge current of an external capacitor.

To achieve these and other advantages and in accordance with the purpose of this specification, as embodied and broadly described herein, there is provided a fast switch, including: a housing; a vacuum interrupter installed in the housing, connected to a main circuit, and configured to open and close the main circuit; a contact spring coupled to a mover of the vacuum interrupter, and configured to provide a contact force; an insulating rod connected to the contact spring; a permanent magnet actuator connected to a lower end of the insulating rod, and configured to provide a switching driving force; a first capacitor configured to provide a discharge current to a coil of the permanent magnet actuator; a driving coil connected to a lower end of the permanent magnet actuator; and a second capacitor configured to provide a discharge current to the driving coil.

The coil may include an open coil configured to make the vacuum interrupter perform an opening operation; and a close coil configured to make the vacuum interrupter perform a closing operation.

The fast switch may further include a permanent magnet actuator controller formed between the permanent magnet actuator and the first capacitor, and configured to perform signal transmission and control.

The fast switch may further include a driving coil controller formed between the driving coil and the second capacitor, and configured to perform signal transmission and control.

A sensor may be provided between the main circuit and the permanent magnet actuator controller and the driving coil controller, and the sensor may be configured to transmit a signal generated from the main circuit to the permanent magnet actuator controller and the driving coil controller.

The fast switch may further include a repulsive plate provided below the driving coil, and vertically moving by an electronic repulsive force generated by a magnetic force of the driving coil.

A discharge current may flow to the open coil from the first capacitor, for prevention of a re-closing operation of the main circuit due to the electronic repulsive force of the repulsive plate when the vacuum interrupter performs an opening operation.

The first capacitor and the second capacitor may be provided inside or outside the housing.

The fast switch according to an embodiment of the present invention can have the following advantages.

Firstly, since the fast switch perform an opening operation and a closing operation by a discharge current generated from the first capacitor and the second capacitor installed inside or outside the housing, a circuit interrupting operation can be instantly performed regardless of a size of a fault current, when the main circuit is interrupted.

Secondly, since a capacity, a charging voltage, etc. of the first capacitor and the second capacitor can be controlled, a circuit interrupting operation can be performed at a user's desired operation speed.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIGS. 1A and 1B illustrate a principle of a fault current limiter, in which FIG. 1A illustrates a circuit where only a circuit breaker is installed, and FIG. 1B illustrates a circuit where a fault current limiter and a circuit breaker are installed;

DETAILED DESCRIPTION OF THE INVENTION

Description will now be given in detail of preferred configurations of a fast switch according to an embodiment of the present invention, with reference to the accompanying drawings.

Figure 1A:
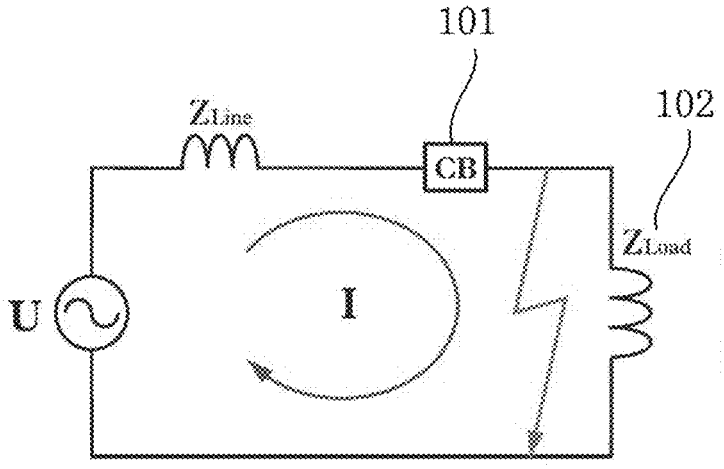
Fig. 1A Prior Art
Figure 1B:
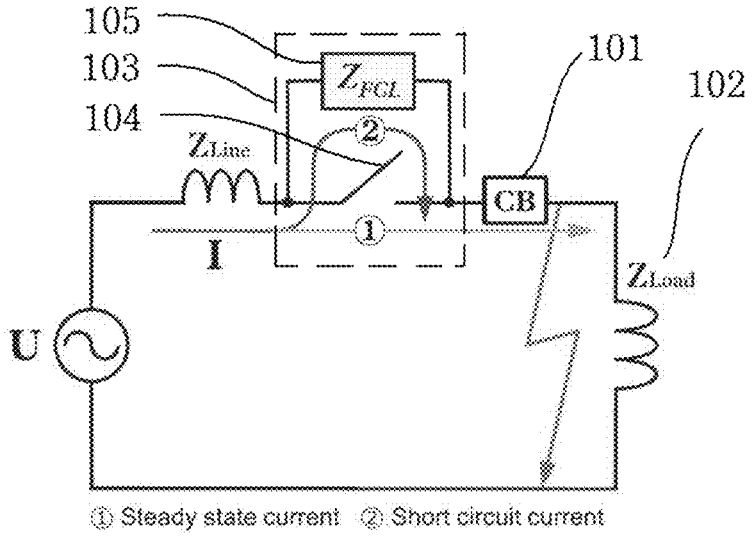
Fig. 1B Prior Art
Figure 2:
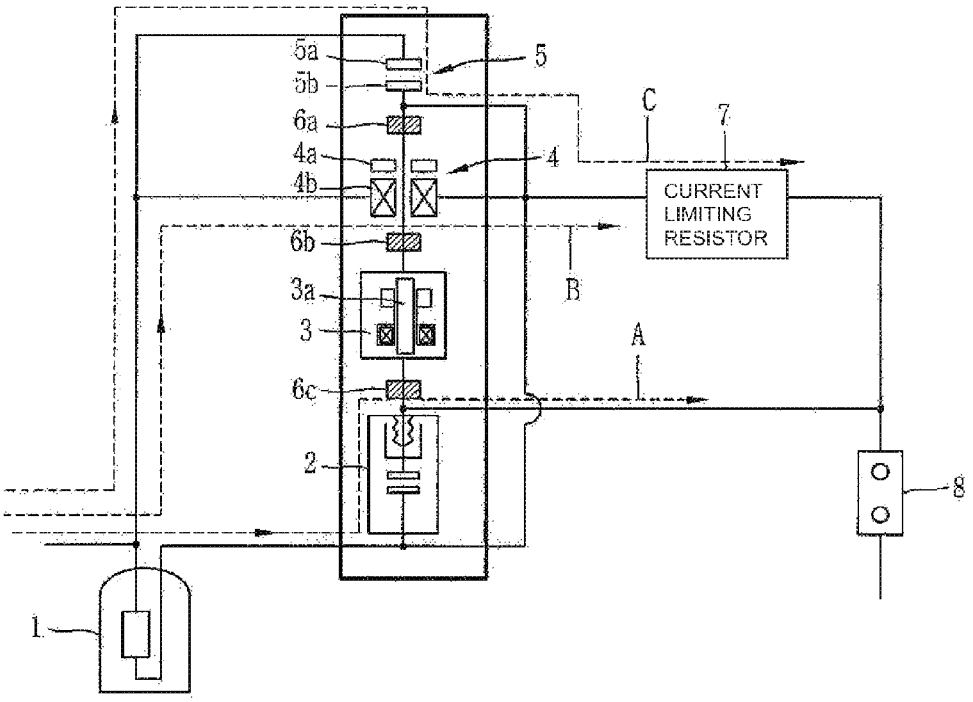
Fig. 2 Prior Art
FIG. 2 is a view illustrating a configuration of a fault current limiter in accordance with the conventional art.
Figure 3:
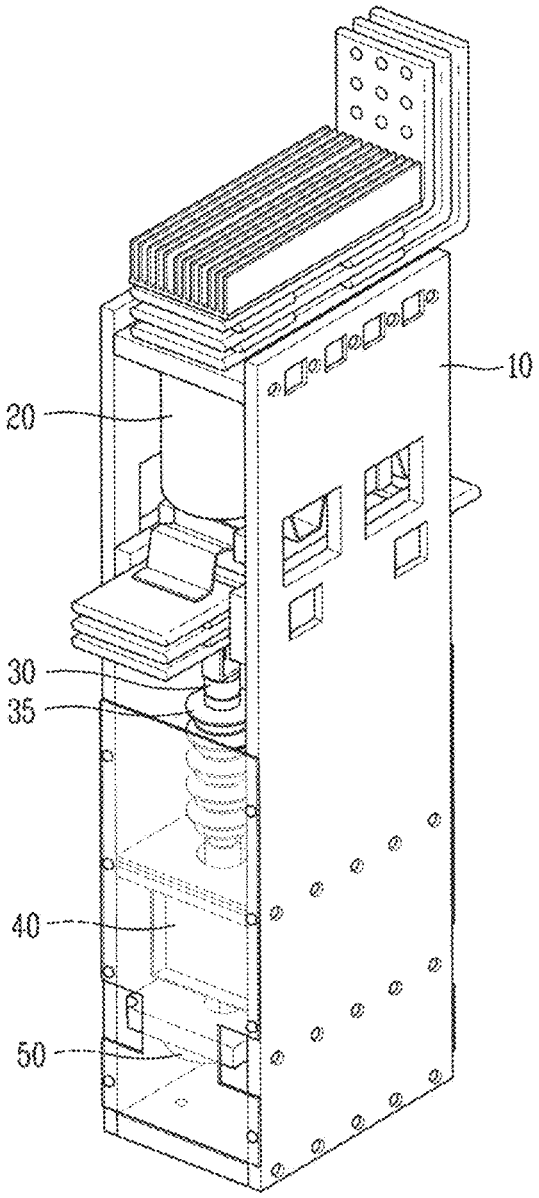
FIG. 3 is a perspective view of a fast switch according to an embodiment of the present invention.
Figure 4:
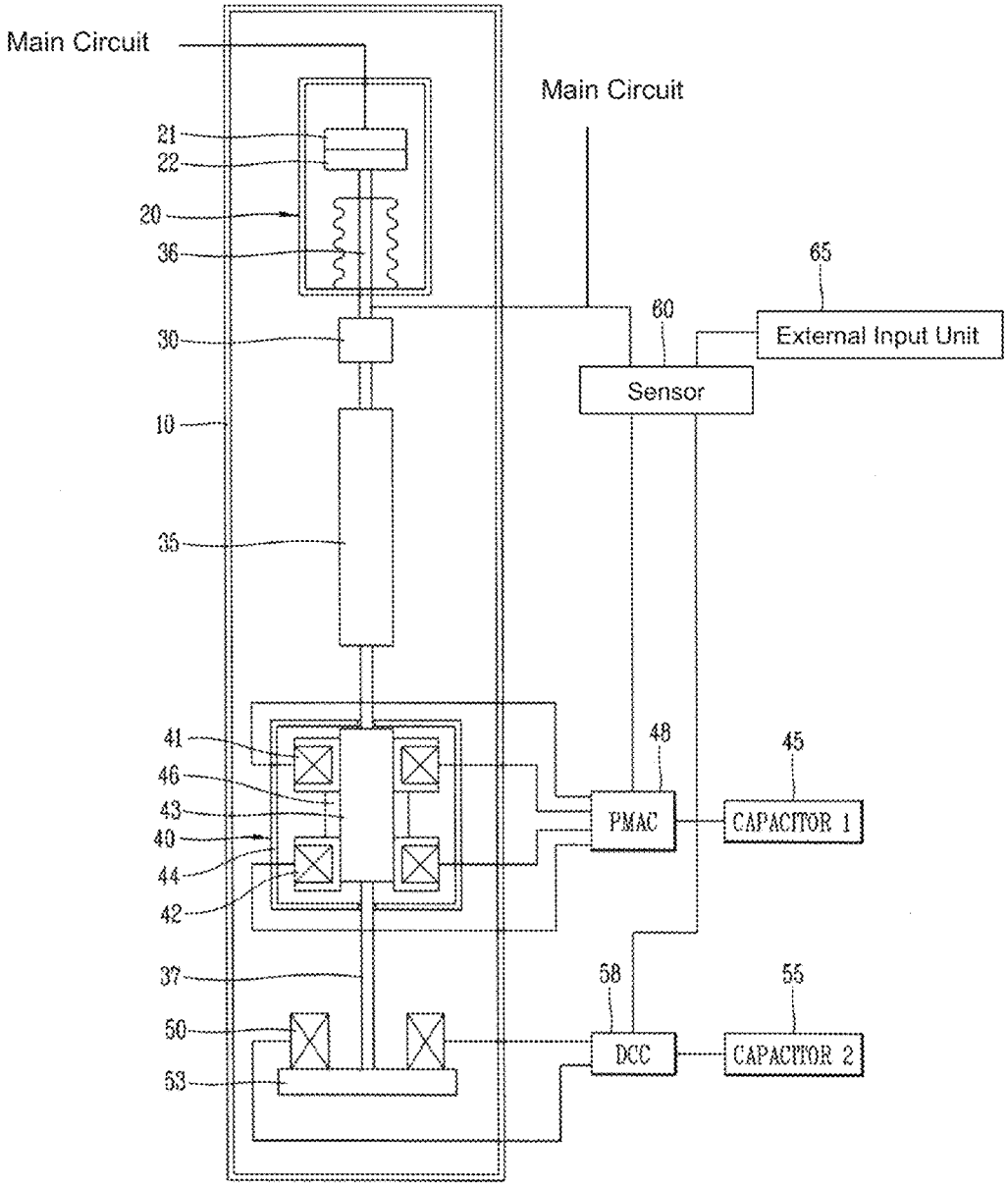
FIG. 4 is a view illustrating a configuration of a fast switch according to an embodiment of the present invention, in which a vacuum interrupter is in a closed state.
Figure 5:
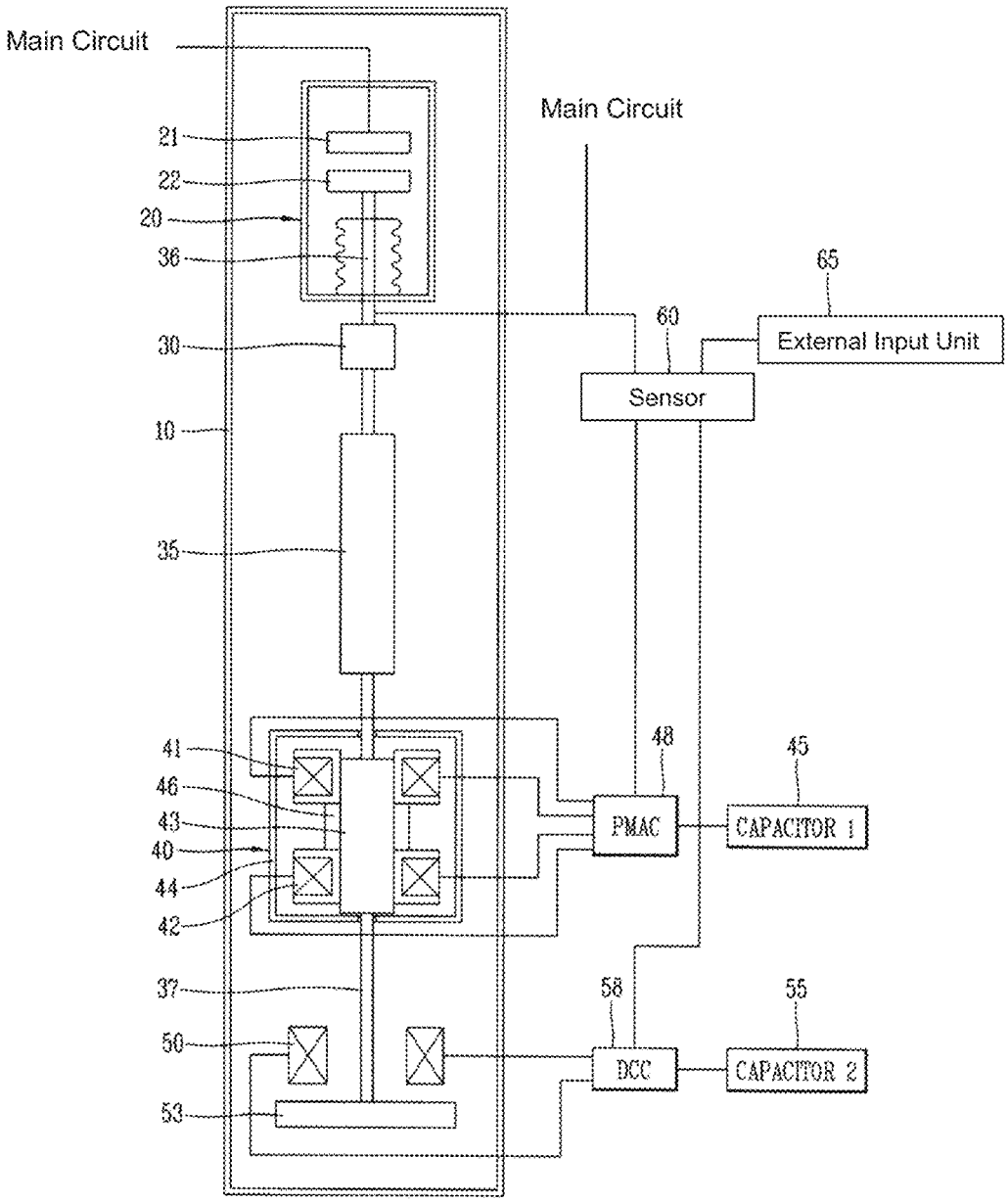
FIG. 5 is a view illustrating a configuration when the vacuum interrupter of FIG. 4 is in an open state.

FIG. 3 is a perspective view of a fast switch according to an embodiment of the present invention. FIG. 4 is a view illustrating a configuration of a fast switch according to an embodiment of the present invention, in which a vacuum interrupter is in a closed state. FIG. 5 is a view illustrating a configuration when the vacuum interrupter of FIG. 4 is in an open state.

A fast switch according to an embodiment of the present invention includes a housing 10; a vacuum interrupter 20 installed in the housing 10, connected to a main circuit, and configured to open and close the main circuit; a contact spring 30 coupled to a movable portion of the vacuum interrupter 20, and configured to provide a contact force; an insulating rod 35 connected to the contact spring 30; a permanent magnet actuator 40 connected to a lower end of the insulating rod 35, and configured to provide a switching (opening/closing) driving force; a first capacitor 45 configured to provide a discharge current to a close coil 41 of the permanent magnet actuator 40; a driving coil 50 connected to a lower end of the permanent magnet actuator 40; and a second capacitor 55 configured to provide a discharge current to the driving coil 50.

The housing 10 may be formed to have a box shape where front and rear surfaces are open. The housing 10 is configured to accommodate therein various types of components of the fast switch according to an embodiment of the present invention.

The vacuum interrupter 20 includes a fixed contact 21, and a movable contact 22 configured to contact or to be separated from the fixed contact 21. When a normal current flows, the fixed contact 21 and the movable contact 22 are in a contacted state. However, when a fault current occurs, the fixed contact 21 and the movable contact 22 are separated from each other, such that the fault current detours to a current limiting resistor (not shown). Under such a configuration, an accident can be prevented and a power system can be protected.

The contact spring 30 provides a contact force to the movable portion of the vacuum interrupter 20, thereby enhancing a conducting function. Further, the contact spring 30 compensates for loss due to repeated switching operations, thereby maintaining a constant interrupting operation.

The permanent magnet actuator 40 includes a frame 44, a close coil 41 installed in the frame 44, an open coil 42, a permanent magnet 46, and a mover 43 moved by a magnetic force generated from the close coil 41 and the open coil 42. The permanent magnet actuator 40 is provided with the close coil 41 and the open coil 42, and allows the vacuum interrupter 20 to perform a switching operation. More specifically, for an opening operation, the permanent magnet actuator 40 performs a latch function to prevent a re-closing phenomenon. On the other hand, for a closing operation, the permanent magnet actuator 40 provides a driving force. A discharge current, generated from the first capacitor 45 which is to be explained, selectively flows to the close coil 41 or the open coil 42.

The first capacitor 45 is connected to each of the close coil 41 and the open coil 42 of the permanent magnet actuator 40, thereby providing a discharge current thereto.

A permanent magnet actuator controller (PMAC) 48 may be installed between the permanent magnet actuator 40 and the first capacitor 45. The permanent magnet actuator controller (PMAC) 48 may perform signal transmission and control with respect to the first capacitor 45. For instance, the permanent magnet actuator controller (PMAC) 48 may determine whether current discharged from the first capacitor 45 is made to flow to the close coil 41 or the open coil 42.

The driving coil 50 provides a driving force required for the vacuum interrupter 20 to perform an opening operation, together with a repulsive plate 53.

The second capacitor 55 is connected to the driving coil 50, thereby providing a discharge current.

A driving coil controller (DCC) 58 may be installed between the driving coil 50 and the second capacitor 55. The driving coil controller (DCC) 58 may perform signal transmission and control with respect to the second capacitor 55.

The repulsive plate 53 is installed at a lower end of a lower moving rod 37, and is vertically moved by an electronic repulsive force generated by a magnetic force of the driving coil 50.

An upper moving rod 36 coupled to the movable contact 22 of the vacuum interrupter 20, the insulating rod 35 installed between the vacuum interrupter 20 and the permanent magnet actuator 40, the mover 43 of the permanent magnet actuator 40, and the lower moving rod 37 installed between the permanent magnet actuator 40 and the repulsive plate 53 are connected to one another in series, thereby being moved in an integral manner.

The fast switch according to an embodiment of the present invention may further include a sensor 60. The sensor 60 may transmit a signal, as one end thereof is connected to a main circuit, and another end thereof is connected to the driving coil controller 58 and the permanent magnet actuator controller 48. For instance, the sensor 60 may receive a fault current signal generated from the main circuit, and may transmit the received fault current signal to the driving coil controller 58 and the permanent magnet actuator controller 48. The fast switch according to an embodiment of the present invention may further include an external input unit 65 configured to receive a manual input signal transmitted from outside.

An operation of the fast switch according to an embodiment of the present invention will be explained.

Firstly, an instance, where a closing operation of the vacuum interrupter is performed such that current flows on the main circuit in a normal state, will be explained. Current is discharged from the first capacitor 45 by a manual input or when a preset time lapses in the circuit. The current discharged from the first capacitor 45 generates a magnetic force while flowing on the close coil 41 of the permanent magnet actuator 40. The mover 43 is upward moved by a magnetic force generated from the close coil 41. As the mover 43 is moved, the insulating rod 35 and the upper moving rod 36 connected to the mover 43 in series are upward moved in an interworking manner. As a result, the movable contact 22 is also upward moved to contact the fixed contact 21, so that the main circuit is in a conducted state.

In this instance, the contact spring 30 provides a contact force to the movable contact 22, so that the movable contact 22 can contact the fixed contact 21 with a strong force. Further, the contact spring 30 allows the movable contact 22 and the fixed contact 21 to stably contact each other, even when the movable contact 22 and the fixed contact 21 are abraded or compressed by being repeatedly used.

The permanent magnet actuator controller 48 performs control between the first capacitor 45 and the permanent magnet actuator 40. That is, the permanent magnet actuator controller 48 controls the first capacitor 45 to discharge current, by a signal of the main circuit input from the sensor 60, a manual signal input from the external input unit 65, or a signal internally set. Further, the permanent magnet actuator controller 48 may set a discharge time, a current amount, etc. with respect to current discharged from the first capacitor 45.

Next, will be explained a case where the vacuum interrupter performs an opening operation (trip operation) when a fault current occurs, such that the main circuit is interrupted and the fault current is made to detour to an auxiliary circuit (not shown) to which a current limiting resistor (not shown) is connected. Current is discharged from the second capacitor 55 when a fault current flows on the main circuit, or by a manual input. The current discharged from the second capacitor 55 generates a magnetic force while flowing on the driving coil 50. The repulsive plate 53, which receives an electronic repulsive force by the magnetic force generated from the driving coil 50, is downward moved. As the repulsive plate 53 is moved, the lower moving rod 37, the mover 43, the insulating rod 35, and the upper moving rod 36 which are connected to the repulsive plate 53 in series are downward moved in an interworking manner. As a result, the movable contact 22 is separated from the fixed contact 21, and the main circuit is interrupted.

The driving coil controller 58 performs signal transmission and control between the second capacitor 55 and the driving coil 50. That is, as a signal of the main circuit input from the sensor 60 or a manual signal introduced from the external input unit 65 is transmitted, current of the second capacitor 55 is discharged. Further, a discharge time, a current amount, etc. with respect to current discharged from the second capacitor 55 may be set.

For prevention of a re-closing phenomenon occurring due to a repulsive force of the repulsive plate 53 during a trip operation, a discharge current from the first capacitor 45 flows to the open coil 42 of the permanent magnet actuator 40. As a result, the mover 43 is downward moved.

The fast switch according to an embodiment of the present invention performs an opening operation and a closing operation by a discharge current generated from the first capacitor 45 and the second capacitor 55. Thus, a circuit interrupting operation can be constantly performed regardless of a size of a fault current, when the main circuit is interrupted.

Further, since a capacitance of the capacitor, a charging voltage, etc. are controllable, an interrupting operation can be performed at a user's desired operation speed.

Further, since the fast switch of the present invention has a shorter driving time than a fast switch of a mechanical mechanism, a fault current can be detoured within a ½ cycle.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A fast switch, comprising:

a housing;

a vacuum interrupter installed in the housing, connected to a main circuit, and configured to open and close the main circuit;

a contact spring coupled to a mover of the vacuum interrupter, and configured to provide a contact force;

an insulating rod connected to the contact spring;

a permanent magnet actuator connected to a lower end of the insulating rod, and configured to provide a switching driving force;

a first capacitor configured to provide a discharge current to a coil of the permanent magnet actuator;

a driving coil connected to a lower end of the permanent magnet actuator; and a second capacitor configured to provide a discharge current to the driving coil.

2. The fast switch of claim 1, wherein the coil includes:

an open coil configured to allow the vacuum interrupter to perform an opening operation; and a close coil configured to allow the vacuum interrupter to perform a closing operation.

3. The fast switch of claim 1, further comprising a permanent magnet actuator controller formed between the permanent magnet actuator and the first capacitor, the permanent magnet actuator controller configured to perform signal transmission and control.

4. The fast switch of claim 1, further comprising a driving coil controller formed between the driving coil and the second capacitor, the driving controller configured to perform signal transmission and control.

5. The fast switch of claim 2, further comprising a repulsive plate provided below the driving coil, the repulsive plate vertically moving by an electronic repulsive force generated by a magnetic force of the driving coil.

6. The fast switch of claim 5, wherein a discharge current flows to the open coil from the first capacitor, for prevention of a re-closing operation of the main circuit due to the electronic repulsive force of the repulsive plate when the vacuum interrupter performs an opening operation.

7. The fast switch of claim 4, wherein a sensor is provided between the main circuit and the permanent magnet actuator controller and the driving coil controller, the sensor configured to transmit a signal generated from the main circuit to the permanent magnet actuator controller and the driving coil controller.

8. The fast switch of claim 1, wherein the first capacitor and the second capacitor are provided inside or outside the housing.

* * * * *